US006739484B2

(12) United States Patent
Finley

(10) Patent No.: US 6,739,484 B2
(45) Date of Patent: May 25, 2004

(54) SANITARY LIQUID DISPENSER

(76) Inventor: Matt Finley, 1306 Bohland Pl., St. Paul, MN (US) 55116

( * ) Notice: Subject to any disclaimer, the term of this patent is extended or adjusted under 35 U.S.C. 154(b) by 59 days.

(21) Appl. No.: 10/109,940

(22) Filed: Mar. 28, 2002

(65) Prior Publication Data

US 2003/0183661 A1 Oct. 2, 2003

(51) Int. Cl.[7] ..... B67D 3/00
(52) U.S. Cl. ..... 222/525
(58) Field of Search ..... 222/525

(56) References Cited

U.S. PATENT DOCUMENTS

| | | | | |
|---|---|---|---|---|
| 2,778,521 A | | 1/1957 | Cagle | 215/74 |
| 3,185,341 A | | 5/1965 | Barbour | 220/90.6 |
| D267,397 S | | 12/1982 | Mitchell | D9/444 |
| 4,826,055 A | * | 5/1989 | Stull | 222/524 |
| 4,979,648 A | * | 12/1990 | Montgomery et al. | 222/153.14 |
| 5,632,407 A | | 5/1997 | Christensen | 220/717 |
| 5,971,222 A | | 10/1999 | Caldwell | 222/206 |
| 6,241,127 B1 | | 6/2001 | Caldwell | 222/206 |
| 6,457,596 B1 | * | 10/2002 | Verseman | 215/387 |

* cited by examiner

*Primary Examiner*—Philippe Derakshani
(74) *Attorney, Agent, or Firm*—Angenehm Law Firm; N. Paul Friederichs

(57) ABSTRACT

A cover for a liquid container having a mechanism for selectively attaching the cover to the liquid receptacle, a valve centrally located upon the cover, the valve being adapted to either allow the flow of liquids or disallow the flow of liquids, the valve having a pair of outwardly extending hinged ears pivotal to urge the valve into the on position; a pair of spacing horns formed on the cover, each horn extending upwardly and coaxially from the top surface of the cover proximate the periphery of the cover.

17 Claims, 2 Drawing Sheets

SANITARY LIQUID DISPENSER

BACKGROUND OF THE INVENTION

The invention as described herein relates to liquid dispensers, and more particularly, to portable dispensers for sanitary dispensing liquids for human consumption. When a liquid dispenser or container is used by only one person the problems of the transfer of germs, viruses, and the like does not arise. Unfortunately, this is not a perfect world.

Commonly at an event, the participants will require the infusion of liquids to prevent dehydration brought on by the perspiration of their exertion. The liquid used is most commonly plain water, although, various sweetened or electrolytic replacement types of drinks are also used. Frequently, each participant has his or her own liquid container for fluid replenishment and when each participant limits himself or herself to their own container the problem of transfer of infectious agents does not occur. However, the participants, particularly children, will share a liquid container with other participants and thus share the infectious agents which may lead to the spread of colds, flu, or other communicable diseases.

At some team events, the team will provide a group of liquid dispensers for use by the participants. While, the intent may be to allow each participant to have his or her own liquid dispenser, in the rush of the competition, the "ownership" of a particular dispenser is frequently in question which results in the containers being shared.

Specifically, the problem is that the lips of a person will touch the mouth of the dispenser, contaminating the dispenser with the germs, bacteria, or viruses from the first user. Then the second and subsequent users will drink from the dispenser and inadvertently both share the existing germs, bacteria, and viruses and add their own germs, bacteria, and viruses to the collection on the dispenser. This behavior often leads to the spread of an illness throughout a team or school much to the consternation of the parents.

One attempt to resolve the problem has been the use of disposable drinking cups. However, this produces an additional cost and participants will frequently reuse a drinking cup obviating the sanitary benefit of the disposable cups. Additionally, the use of disposable cups causes difficulties at the container dispensing the liquid when a large group of participants will queue up and mill about trying to fill their cups. Finally, there is the problem of disposing of the used cups.

While in most cases, the illness that spread is something relatively harmless such as a common cold that may have been spread anyway, there is, however, the risk of something more harmful being spread. Regardless of what the participants have been told, there likely will be at least some of the participants who will simply grab the first liquid dispenser found and drink from it thus spreading germs.

What is needed is a sanitary liquid dispenser that is designed to minimize, if not prevent, the spread of germs, bacteria, and viruses by preventing oral contact with the users.

SUMMARY OF THE INVENTION

The invention as disclosed herein is a cover for a liquid container that provides for the sanitary dispensations of liquids to a user. The cover is mated to a conventional bottle using a conventional mating mechanism, such as threads to screw the cover on, or deformable snap fit to snap the cover on or off.

The cover is a similar to a conventional cover and has a central spout for dispensing the liquid. The spout has an on/off valve so that the spout can be turned off and the container moved or stored without spilling the contents. The valve may be a conventional pull-on, push-off valve that is commonly used for water bottles and the like.

The cover may have a pair of upwardly extending horns formed on its periphery. The horns located oppositely on the periphery and extend upwardly from the top surface of the cover. The horns space the face of the user away from the surface of the spout forcing the user to squirt the liquid into the mouth of the user and preventing the user's mouth from contacting the spout, thus preventing the transfer of bacteria, germs, or viruses.

By keeping the spout and top of the cover germ free, the liquid container may be used by one or more user. Even when the best efforts to segregate each user to his or her own liquid container fail, the shared liquid container will allow the sharing of only liquid and not of germs, bacteria, or viruses.

The invention is a sanitary liquid dispenser designed to minimize, if not prevent, the spread of germs, bacteria, and viruses by preventing oral contact with the users.

DESCRIPTION OF THE PREFERRED EMBODIMENT

Figure 1:
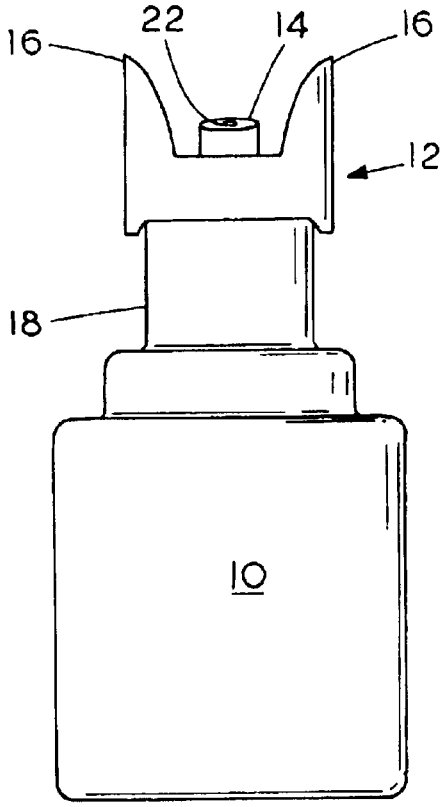
FIG. 1 shows an overall perspective view of the invention attached to a conventional container.
Figure 2:
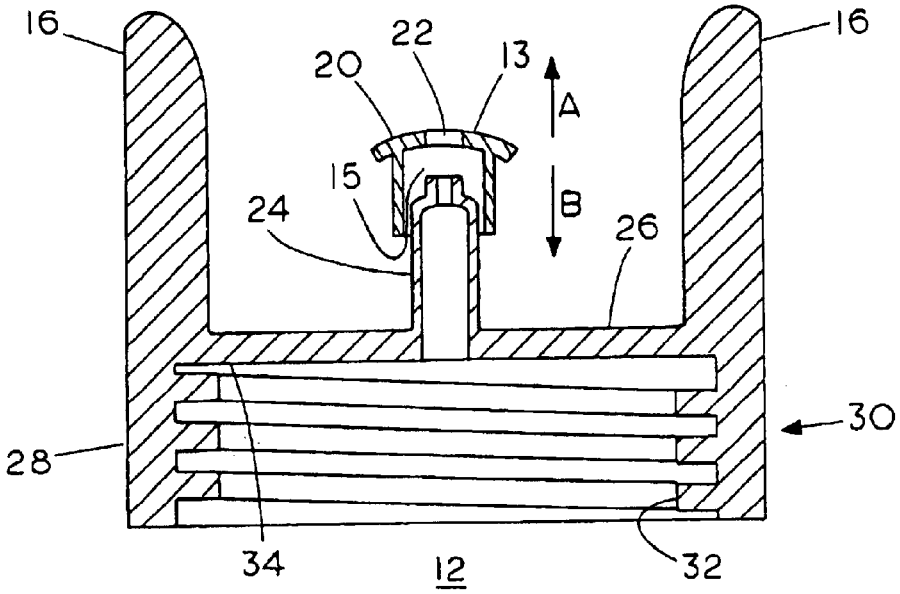
FIG. 2 is a cross sectional view of the invention taken along a diameter of the invention.
Figure 3:
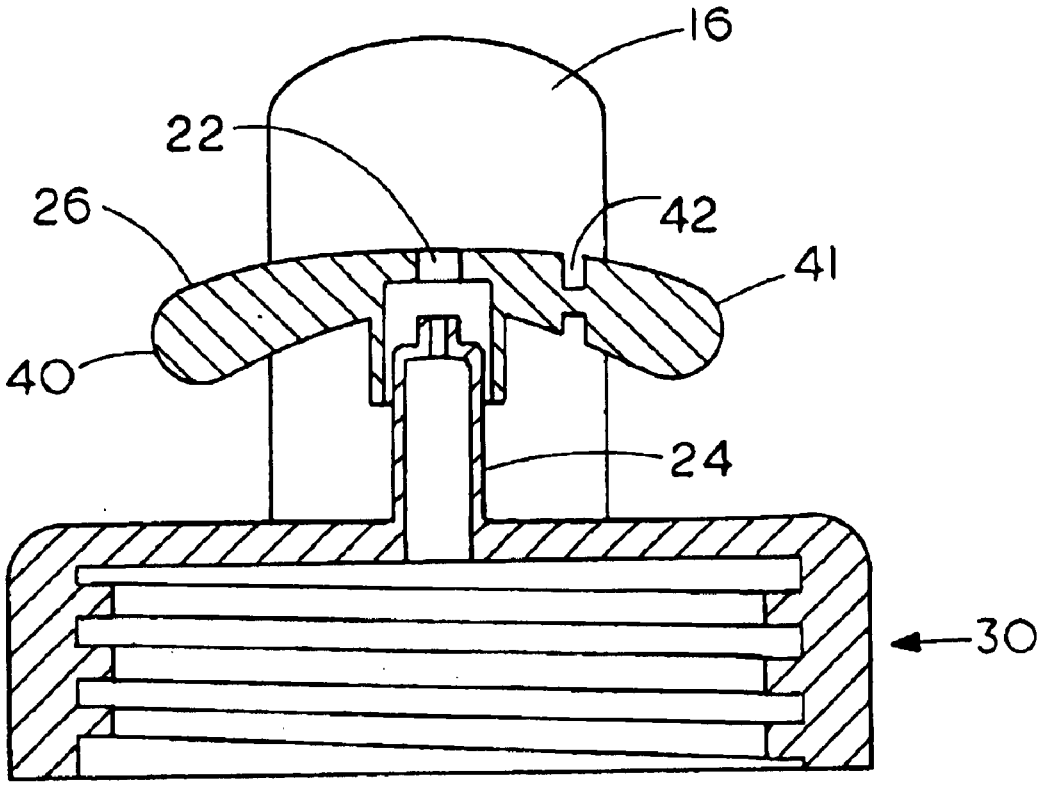
FIG. 3 is a cross sectional view of the invention like FIG. 2, and, rotated a quarter turn showing a second embodiment of the invention.

Looking first to the drawings, FIG. 1 shows the sanitary cover 12 attached to a conventional water bottle 10. The sanitary cover 12 has a centrally located liquid valve 20 that may be opened by urging the valve 20 upwardly or away from the bottle 10 and similarly, the valve 20 may be closed by urging the valve, downwardly toward the bottle 10. The liquid valve 20 may be joined to the nib 24 as shown in FIG. 2. A pair of horns 16 are located on the periphery of the sanitary cover 12, sharing a horizontal plane with the nib 24, being horizontally displaced from the liquid valve 20 and nib 24 and having a central axis that is generally parallel to a central axis of the nib 24 (see FIG. 2) to space the user away from the liquid spout 22. The valve 20 comprises a movable cap 13 centrally affixed on the cover 12 and a central aperture 15, and the cover 12 further includes an upwardly extending reduced diameter nib 24, the nib 24 sized to fit within the central aperture 15 of the cap, the nib 24 further having radial orifices formed therein; the cap 13 further being movable axially such that the cap 12 and nib 24 may closably mate with the central aperture 15 of the cap 13.

The sanitary cover 12 may be attached to the bottle 10 using any suitable mechanism. Examples of mechanisms for attaching the sanitary cover 12 would include mating threads on the bottle 10 an the sanitary cover 12, a sanitary cover 12 fabricated from a sufficiently deformable material to be deformably fit over the bottle 10 and retained by mating lips, or friction. Another example would be a disposable sanitary cover 12 that is placed on the bottle 10 during the manufacturing process after the bottle 10 has been filled with liquid and is intended for a single use followed by disposal or recycling of the bottle 10 and the sanitary cover 12.

A preferred method of attachment would be having male threads formed on the bottle 10 and mating female threads 32 formed on the inside of the skirt 28 of the sanitary cover 12. Thus, the sanitary cover 12 may be removed to allow the bottle 10 to be filled with a liquid of the user's choosing and the sanitary cover 12 replaced and screwed tight using the threads 32 to prevent leakage and allow ease of transport.

The sanitary cover 12 has at least one horn 16 attached to the periphery of the cover 12. The horns 16 extend upwardly from the top surface 26 of the sanitary cover. The horns 16 extend further from the top surface 26 than the spout 22 so as to space the user from the spout 22 and prevent the user from mouthing and drinking from the spout 22. The length of the horns 16 will vary dependent on the distance the horns 16 are spaced apart, the number of horns 16 and the age or size of the intended user. The horns 16 are of sufficient length to preclude a user from placing his or her lips on the spout 22 while drinking, but not being so long as to provide difficulties with the user being unable to squirt the liquid into the user's mouth. Similarly, the spacing of the horns 16 should be sufficient wide so that the horns 16 will abut on the cheeks of the user and not the mouth of the user while being sufficiently narrow so that the horns 16 will not pass outside and beyond the cheeks of the user.

While the sanitary cover may function with a single horn 16, the functionality of the sanitary cover 12 is improved with the use of a plurality of horns. While the use of a single horn 16 does not mandate that the user not place the spout 22 in his or her mouth, it can be easier to drink from the spout 22 with a single horn 16. The plurality of horns 16 effectively recesses the spout 22 away from the face of the user forcing the user to squirt the liquid from the spout 22 into the mouth of the user.

The horns 16 may be of any suitable width and should be of sufficient width and thickness so as to not injure a user. However, when the horns 16 become either individually too wide or too numerous, the horns 16 begin to merge into a ring which will retain the liquid intented to be consumed and the retained liquid may becomes a vehicle for the transfer of germs, bacteria, or viruses.

The horns 16 have been disclosed in a preferred form it is understood that the horns may of a multiplicity of sizes and shapes. Some examples of shapes for horns would include open loops, horns that are bent at a selected distance above the periphery of the cover, or the horns 16 may even be decoratively filigreed. The particular shape of the horns 16 is unimportant so long as the horns 16 provide the mechanism for spacing the face, and more particularly, the lips of a user away from the spout 20 to prevent the user from transferring germs, bacteria, or viruses from the user's mouth to the spout 20 where the germs, bacteria, or viruses may be re-transferred to another user.

The sanitary cover 12 may be fabricated to attach to any standard sized bottle 10 or other container. Examples of standard size bottles would include soft drink bottles, sport drink bottles, bottled water bottles, and water bottles that are sold empty. When used with existing bottles, it is expected that the sanitary cover 12 will be removed from a bottle 10 after use and reused by attachment to another bottle 10.

Conventional soft drink bottles, while varying in capacity, all have consistent sized threads to accept a conventional screw type bottle cap. It is understood that when the sanitary cover 12 is adapted for use with a soft drink bottle, that the sanitary cover 12 will be adapted to have threads to attach to and mate with the male threads of the standard soft drink bottle 10.

Sport drink bottles such as those sold under the trademark of Gator Aide® or other competing products also use a standard sized threaded bottle 10, however, a sport drink bottle is a larger size than a soft drink bottle and thus, the sanitary cover 12 may be constructed having threads sized to mate with the male threads of a sport drink bottle 10.

While two examples of different sized bottles 10 have been illustrated, it is understood that the sanitary cover 12 can be fabricated of any suitable size to fit on a bottle 10 of a selected size. It should be noted, that the spacing of the horns 16 must be retained in the ranges as was previously stated. With a bottle 10 having a particularly small diameter neck 18, the horns 16 may be extended outwardly from the periphery of the sanitary cover 12. Conversely, with a bottle 10 having a particularly large diameter neck 18, the horns 16 may be inset from the periphery of the sanitary cover 12 so as to maintain a proper spacing of the horns 16.

The spout 20 may be a cognitional pull open, as indicated by arrow "A" in FIG. 2; push close, as indicated by arrow "B" in FIG. 2, type of spout 20 and in an alternate embodiment, the spout 20 has outwardly extending ears 40. Additionally, the addition of ears 40 to the spout 20 may further space the fingers of a user away from the spout 20 to reduce the opportunity of the transfer of bacteria, germs, or viruses from the hand on one user to the mouth of another user.

The ears 40 may be simply exertions to the spout 20 to aid in gripping, or the ears 40 may have a hinge 42 formed in its length to allow the ear 40 to hinge and assist the opening of the spout 20. The hinge 42 may be any suitable mechanism to allow the hinging of the hinged ear 41 and is preferably a reduced thickness area to form a bendable area where the hinged ear 41 may be bent to facilitate the opening of the spout 20.

It is preferred that the hinged ear 41 be formed so that the spout 20 may be opened by simply pulling up on the hinged ear 41 or by pressing downwardly and together on the hinged ears 41 so that the hinged ears 41 will operate as a cam to urge the spout 20 away from the cover top surface 26 to open the spout 20 for dispensing the liquid.

In its use, a user will select a bottle 10 with an attached sanitary cover 12 and if necessary, fill the bottle 10 with the user's preferred liquid. When filling the bottle 10 the user will remove the sanitary cover 12 by unscrewing the threads 32 of otherwise operating the attachment mechanism. The opened bottle 10 will then be filled with a selected liquid and the sanitary cover 12 replaced.

To use the sanitary cover 12, the user will first open the spout 20 by urging the spout away from the top surface 26 of the sanitary cover 12. In the first embodiment of the sanitary cover 12, the user will grasp the periphery of the spout 20 and pull. With the second embodiment of the sanitary cover 12, the user will grasp the ears 40, 41 of the spout 20 and either pull the ears 40, 41 or squeeze the hinged ears 41 to urge the spout away from the top surface 26 of the sanitary cover 12 and open the spout 20. With the spout 20 open, the user may then tip the bottle 10 up and while pointing the spout toward the user's mouth squeeze the bottle 10 to squirt the liquid into the user's mouth. When the user has consumed sufficient liquid, the user may relax the grip on the bottle 10 and return the bottle 10 with the sanitary cover 12 to its storage location to await further use.

Although the present invention has been described with reference to preferred embodiments, workers skilled in the art will recognize changes may be made in form and detail without departing from the spirit and scope of the invention

What is claimed:

1. A cover for a liquid receptacle comprising:

a. means for selectively attaching the cover to the liquid receptacle;

b. means for selectively allowing and prohibiting the flow of the liquid from the receptacle; and c. discontinuous means for spacing a user from the means for selectively allowing and prohibiting the flow of the liquid, the means for spacing having a central axis that is generally parallel to a central axis of the means for selectively allowing and prohibiting the flow of the liquid and the discontinuous means extending further from the receptacle than the means for selectively allowing and prohibiting the flow of the liquid.

2. A cover for a liquid container comprising:

a. means for selectively attaching the cover to the liquid receptacle;

b. a valve centrally located upon the cover, the valve being adapted to either allow the flow of liquids or disallow the flow of liquids; and c. at least one spacing horn formed on the cover, each horn extending upwardly and coaxially from the top surface of the cover at the periphery of the cover, the horn extending parallel axially further from the top surface of the cover than the valve to space a user away from the valve.

3. The invention as described in claim 2 wherein the cover further has a downwardly extending skirt and the means for attaching the cover to the liquid receptacle comprises threads formed on the cover skirt and mating threads formed on the liquid receptacle.

4. The invention as described in claim 3 wherein the threads on the cover skirt are female and the threads on the receptacle are male.

5. The invention as described in claim 2 wherein the cover further has a downwardly extending skirt and the means for attaching the cover to the liquid receptacle comprises selectively deforming the cover skirt to matingly attach to the liquid receptacle.

6. The invention as described in claim 2 wherein the valve comprises a movable cap centrally affixed on the cover and a central aperture, and the cover further includes an upwardly extending reduced diameter nib, the nib sized to fit within the central aperture or the cap, the nib further having radial orifices formed therein; the cap further being movable axially such that the cover nib may closably mate with the central aperture of the cap.

7. The invention as described in claim 6 wherein the cap further comprises at least one outwardly extending flexible ear.

8. The invention as described in claim 2 wherein the cap further comprises at least one outwardly extending flexible ear.

9. The invention as described in claim 7 wherein the at least one outwardly extending flexible ear is hingedely attached to the cap.

10. The invention as described in claim 8 wherein the hinged ears are rotatable to abut the cap and urge the valve into an open position.

11. The invention as described in claim 2 wherein there are two horns.

12. The invention as described in claim 11 therein the horns occupy less than one half of the circumference of the periphery of the cover.

13. A liquid container with a dispensing cover comprising a) a liquid container having an opening and means for attaching a cover;

b) a cover for selective attachable to the container; the cover having a centrally disposed spout, the spout further including a valve for controlling the flow of liquid; and means for attaching the container; and c) at least one horn affixed to the cover and extending straight away from the container to a point beyond the valve for spacing a user away from the spout.

14. The device as described in claim 13 having a pair of horns.

15. The device as described in claim 13 wherein the at least one horn further comprises an open loop.

16. The device as described in claim 13 wherein the at least one horn extends away from the container and therefrom curves.

17. The device as described in claim 13 wherein the valve is a pull to open, push to close gate valve.

* * * * *